US006237772B1

(12) United States Patent
LaMarche et al.

(10) Patent No.: US 6,237,772 B1
(45) Date of Patent: May 29, 2001

(54) ASSEMBLY OF INTERCONNECTED CONTAINERS AND CONTAINERS FOR USE THEREIN

(75) Inventors: Paul E. LaMarche, Waterford; Victor Golani, Northville; James P. McCarthy, Milford, all of MI (US); James E. Smith, Bruceton Mills; Gregory J. Thompson, Morgantown, both of WV (US)

(73) Assignee: Neotech Industries, Inc., Waterford, MI (US)

( * ) Notice: Subject to any disclaimer, the term of this patent is extended or adjusted under 35 U.S.C. 154(b) by 0 days.

(21) Appl. No.: 09/416,651

(22) Filed: Oct. 12, 1999

Related U.S. Application Data

(63) Continuation-in-part of application No. 09/028,888, filed on Feb. 24, 1998, now Pat. No. 5,964,350.

(51) Int. Cl.[7] ..... B65D 73/00

(52) U.S. Cl. ..... 206/470; 206/471; 206/504; 206/509; 206/806

(58) Field of Search ..... 206/464, 465, 206/468, 470, 471, 404, 509, 775, 776, 806, 508; 220/4.22, 4.23, 4.26; 446/72, 73

(56) References Cited

U.S. PATENT DOCUMENTS 2,506,844 * 5/1950 Smith ..... 206/508
3,401,993 * 9/1968 Fenkel ..... 206/508
3,696,966 * 10/1972 Herolzer ..... 206/509
3,701,079 * 10/1972 Bowden et al. ..... 206/508
5,699,925 * 12/1997 Petruzzi ..... 220/4.27
5,954,203 * 9/1999 Marconi ..... 206/464

* cited by examiner

*Primary Examiner*—Paul T. Sewell
*Assistant Examiner*—Shian Luong
(74) *Attorney, Agent, or Firm*—William F. Lang, IV; Michael D. Lazzara; Eckert Seamans Cherin & Mellott, LLC

(57) ABSTRACT

An assembly of interconnected containers includes a plurality of containers each of which has an upper portion connected to a lower portion by a hinge or hinges with the upper portion having a pair of elongated generally parallel upwardly open channels. The container also has a pair of generally parallel generally downwardly projecting flanges structured to engage an upwardly open channel of an adjacent container and adjacent containers have either at least one of the channels engaged by a flange of an adjacent container or at least one of its flanges engaged in a channel of an adjacent container or both. The channels are preferably open having at least one end so as to permit relative sliding removal and insertion of the containers from and into the assembly. In another embodiment, a rail and flange structure is provided to interengage adjacent containers within an assembly. A container can also be provided that has a lid portion hingably attached to the upper portion of the container. This "split" clamshell embodiment permits articles to be removed from the container without removal of the container from the assembly of interconnected containers. The containers may be transparent and molded as a unit with integrally formed hinges. Support structures may be provided within the container to support one or more articles disposed therein. Individual containers for use in such an assembly are disclosed.

27 Claims, 15 Drawing Sheets

ASSEMBLY OF INTERCONNECTED CONTAINERS AND CONTAINERS FOR USE THEREIN

CROSS-REFERENCE TO RELATED APPLICATIONS

This application is a continuation-in-part of U.S. patent application Ser. No. 09/028,888 filed Feb. 24, 1998 which issued on Oct. 12, 1999 as U.S. Pat. No. 5,964,350.

BACKGROUND OF THE INVENTION

1. Field of the Invention

The present invention relates to containers which are usable to store collectibles as well as a wide variety of other articles and are structured to be employed in assemblies which may be self-supporting assemblies adapted to have individual containers removed therefrom and restored thereto without disassembly of the entire assembly.

2. Background Information

It has been known for many purposes to transport, store and display various types of collectibles such as dolls, small stuffed animals and a wide variety of other articles, which may or may not be collectibles, in such a manner that they are fully protected from infiltration of dirt, structural damage and the effects of sunlight, while permitting ready viewing of all or substantially all of the article.

It has been known to assemble such containers from individual molded components and to make such components from a resinous plastic material. For example, it has been known to display hockey pucks and baseballs in transparent resinous plastic containers which have a supporting base and transparent portions which surround and correspond generally to the shape of the respective hockey pucks and baseballs.

One of the problems encountered with respect to such containers is the need to have adequate shelf space to support the same or, in lieu thereof, to employ the upper surfaces of furniture such as a table, desk or bookcase, for example, for support.

It has been known for restaurants and other suppliers of prepared food to employ clamshell-type resinous plastic containers which have upper and lower hinged portions which are adapted to be interlocked and serve to permit transport of the food as well as, in some instances, consumption of the food directly from the containers. Such containers are not, however, adapted to be employed to create a self-supported assembly of articles which are intended to be stored for a longer period than prepared food. There remains a need for such containers and assemblies.

SUMMARY OF THE INVENTION

The present invention has met the above described needs by providing an assembly of interconnected containers. A plurality of containers each have an upper portion connected to a lower portion by hinge means with the upper portion having a pair of elongated generally parallel, upwardly open channels. Each container has a pair of generally parallel, generally downwardly projecting flanges structured to engage an upwardly open channel of an adjacent container. The assembly is established by having one or more flanges of a first container engaging one or more channels of second containers.

The channels and associated cooperating flanges permit relative longitudinal sliding movement between containers for insertion of a container into the assembly and removal of a container therefrom. In a preferred embodiment, the flanges consist of a first flange portion formed within the lower part of the upper portion of the container and a second flange portion formed within the upper part of the lower portion of the container with the two flange portions being in superposed relationship.

The containers are preferably transparent and molded as a unit from a resinous plastic material.

Containers of the described configuration may be provided with interior support means to support an article being displayed therein.

It is an object of the present invention to provide a resinous plastic container which is structured to be interengaged with other containers in establishing a self-supporting assembly of such containers.

It is another object of the present invention to provide such containers and assemblies thereof wherein a number of individual containers may be inserted into and removed from the assembly without destroying the structural integrity of the assembly.

It is a further object of the present invention to provide such containers whose contents may be accessed without their complete removal from an assembly of the containers.

It is a further object of the present invention to provide such containers in a staggered arrangement within assemblies thereof.

It is a further object of the present invention to provide containers of varying dimensions within a common assembly structure of such containers.

It is a further object of the present invention to provide such a system which employs containers which are lightweight, economical to manufacture and to use and have adequate strength for the intended purpose.

It is a further object of the present invention to provide such an assembly which will provide substantially complete visibility of the article contained therein while effectively resisting entry of dirt, physical handling or damage to the article.

These and other objects of the present invention will be more fully understood from the following description of the invention on reference to the illustrations appended hereto.

DESCRIPTION OF THE PREFERRED EMBODIMENTS

As used herein, the term "article" shall expressly include but not be limited to collectibles of various types including dolls, stuffed animals, figurines, sports memorabilia, medallions, models and shall also include useful articles such as shoes, clothing and tools.

Figure 1:
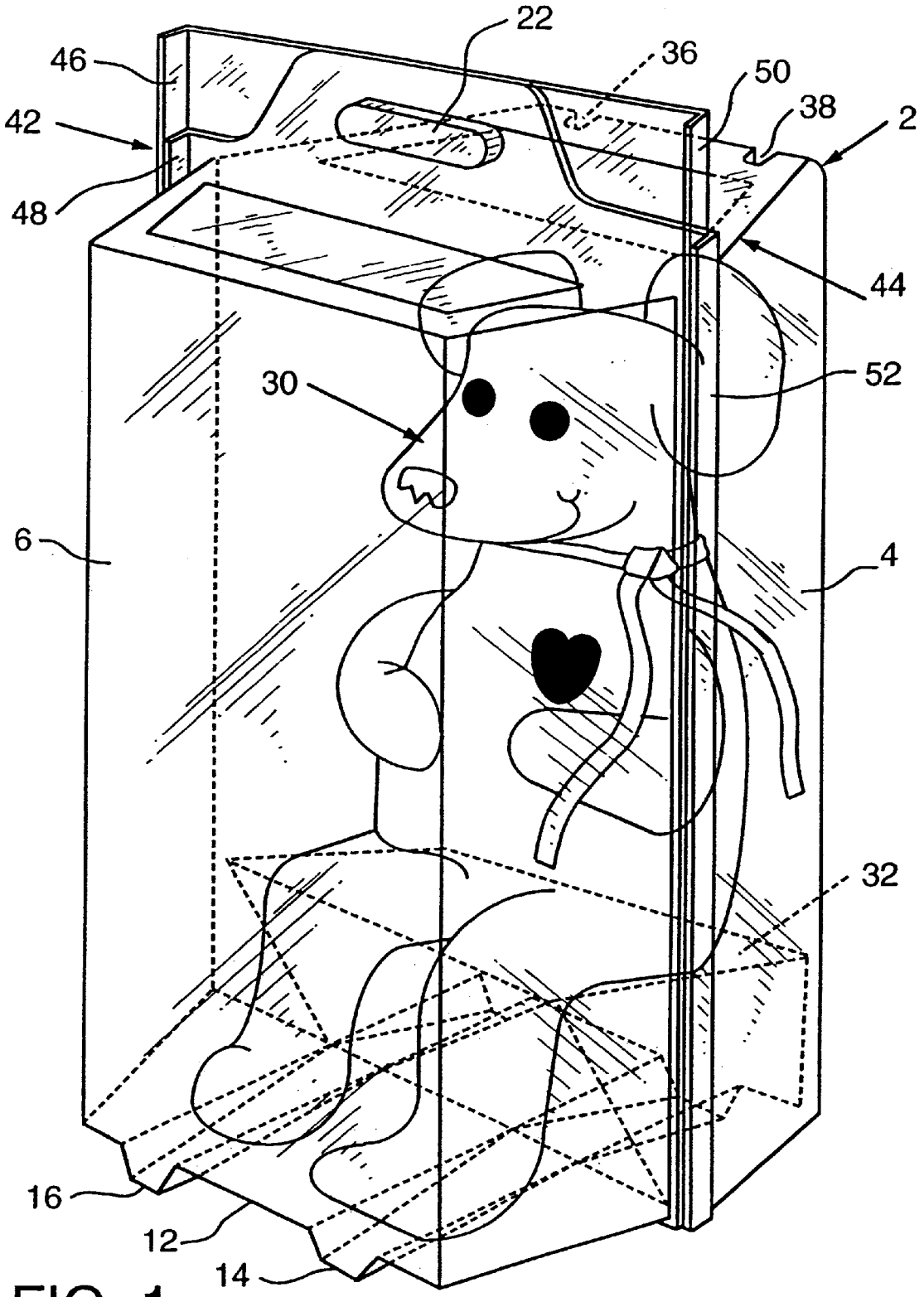
FIG. 1 is a perspective view of a container of the present invention within which is disposed a three-dimensional animal figure.
Figure 2:
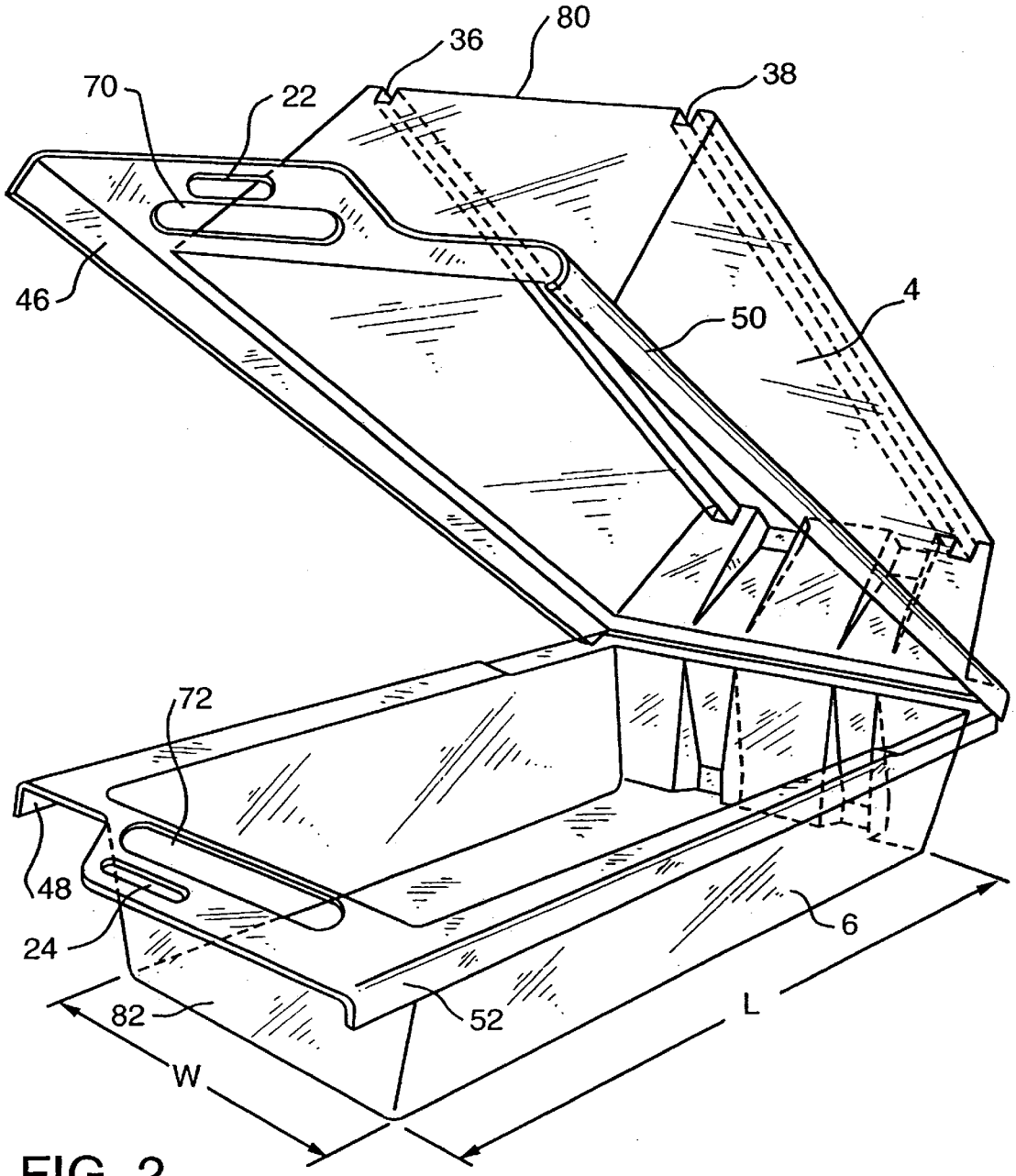
FIG. 2 is a perspective view of an embodiment of the container of the present invention shown in an open position.
Figure 3:
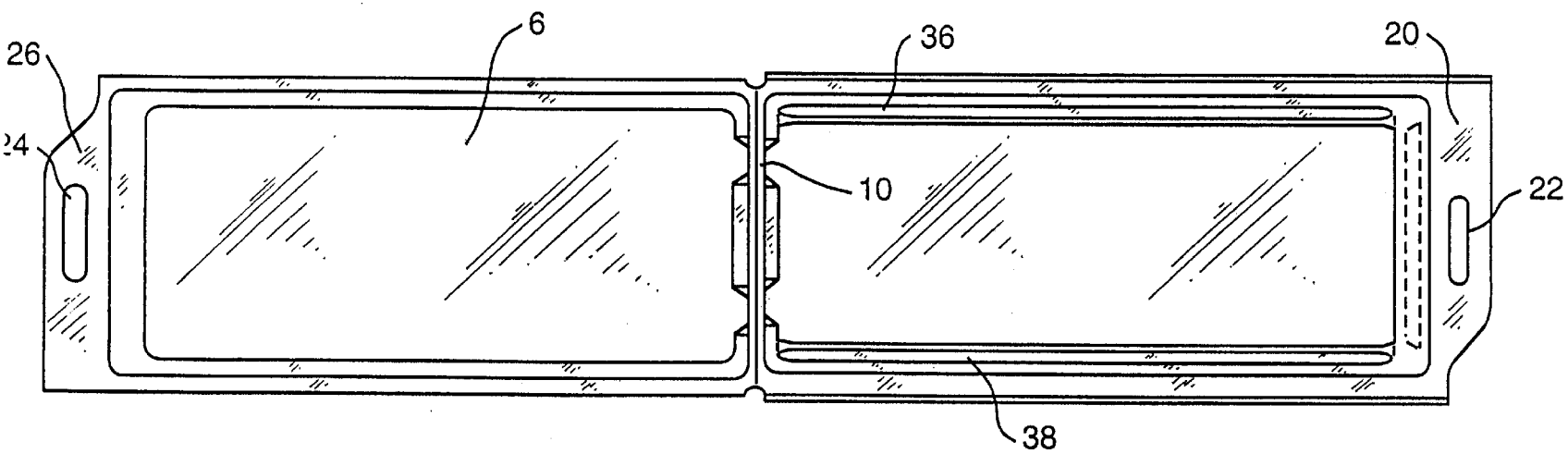
FIG. 3 is a top plan view of a modified version of the container of FIG. 2 shown in the open position.

Referring to FIGS. 1–4, there is shown a container 2 which has an upper portion 4 and a lower portion 6, hinge means 10 which, in the form shown, are integrally molded connecting portions which create a clamshell-type container are provided. In the form shown, an irregularly configured support 12 has a pair of sloping support contacting segments 14, 16 so as to stabilize the member when it rests on a support wall 12 as shown in FIGS. 1–3. In FIG. 1, there is also shown a projecting extension 20 which contains a plug 22 which, when the container 2 is in closed position, will be received in opening 24 on extension 26 so as to lock the assembly in closed position as shown. In the form shown in FIG. 1, a stuffed animal 30, generally in the form of a mouse, is shown seated on an interior support 32. It will be appreciated that with the container made of a transparent material the full article can be viewed from various angles without requiring opening the same to risk damage thereto and permit dirt to enter the container 2 and come in contact with the article. If desired, the material out of which the container is made may be tinted or contain an additive to resist passage of ultraviolet radiation therethrough. Many suitable ultraviolet inhibitors are known to those skilled in the art and thereby resist ultraviolet damage to the article.

Figure 4:
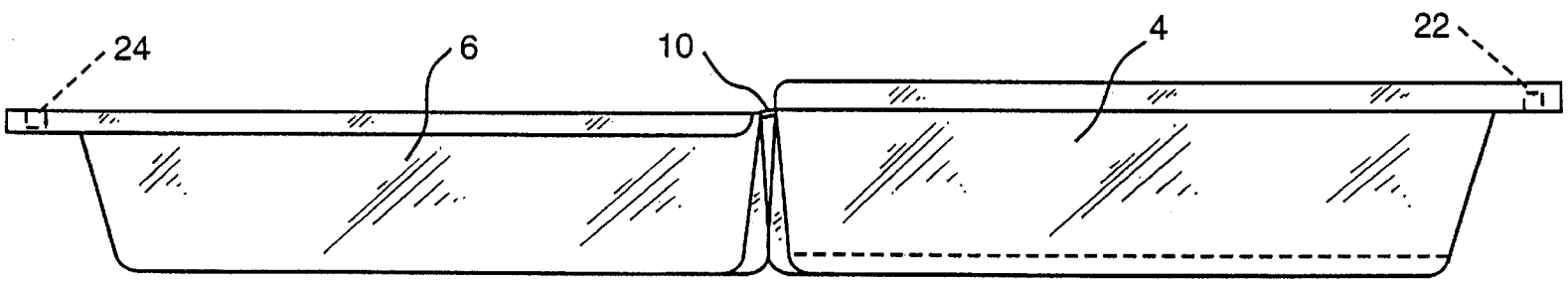
FIG. 4 is a front elevational view of the container of FIG. 3.

For many uses, the container, as shown in FIGS. 3 and 4, will have the base 6 resting on a support surface with the upper portion 4 overlying the same. For convenience of reference and consistency of disclosure herein, when the container is in a closed position, the channels 36, 38 which are integrally formed within the upper portion 4 will be described as being upwardly open. Shown in FIGS. 1 and 2 are the downwardly projecting flange means 42, 44. Flange 42 consists of a first downwardly projecting portion 46 which is formed in the lower part of upper portion 4 and a second portion 48 which is formed in the upper part of lower portion 6. Portions 46, 48 are superposed on each other and are adapted to be received in an upwardly open channel such as 38 of an adjacent container in establishing the assembly in the manner to be described herein. Similarly, flange 44 has portion 50 formed in the lower part of upper portion 4 and portion 52 formed in the upper part of lower portion 6.

It will be appreciated that the configurations of the containers are such that they, when empty and open, may be nested for shipment to the destination where they will be used.

In the embodiment shown in FIG. 2, in addition to the locking means 22, 24 there is a finger-receiving opening formed by adjacent openings 70, 72 when the container is in closed position. While the dimensions of the container will vary according to the particular end use desired, the container may, for example, have a length L of about 4 to 12 inches, a width W of about 2 to 12 inches and an overall height when closed measured between the upper surface 80 of the upper portion 4 and the lower surface 82 of lower portion 6 of about 2 to 6 inches. In a preferred embodiment, the wall thickness of the container which may be about 0.010 to 0.060 inch and most preferably about 0.020 to 0.025 inch. It will be appreciated that while the material and thickness of the material may provide a certain degree of flexibility to the container, that it is such as to retain its molded shape. Among the materials preferred for manufacture of the containers are polycarbonate polyvinyl chloride and acrylonitrile butadiene styrene (ABS).

If desired, the locking means of FIGS. 1 through 4 may be eliminated and the flanges 42, 44 may be configured to interlock with each other.

Figure 5:
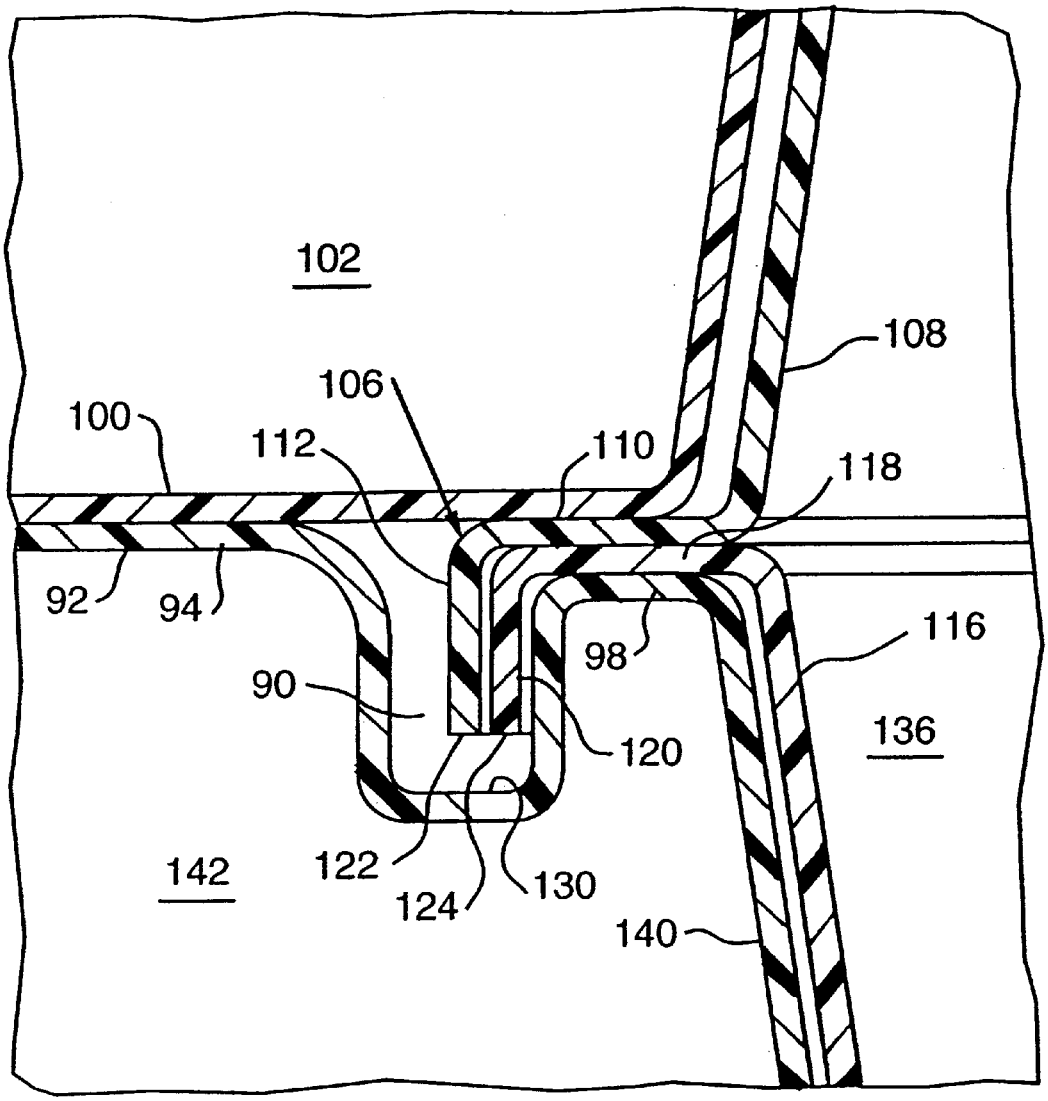
FIG. 5 is a fragmentary cross-sectional illustration showing details of interengagement of containers of the present invention.
Figure 6:
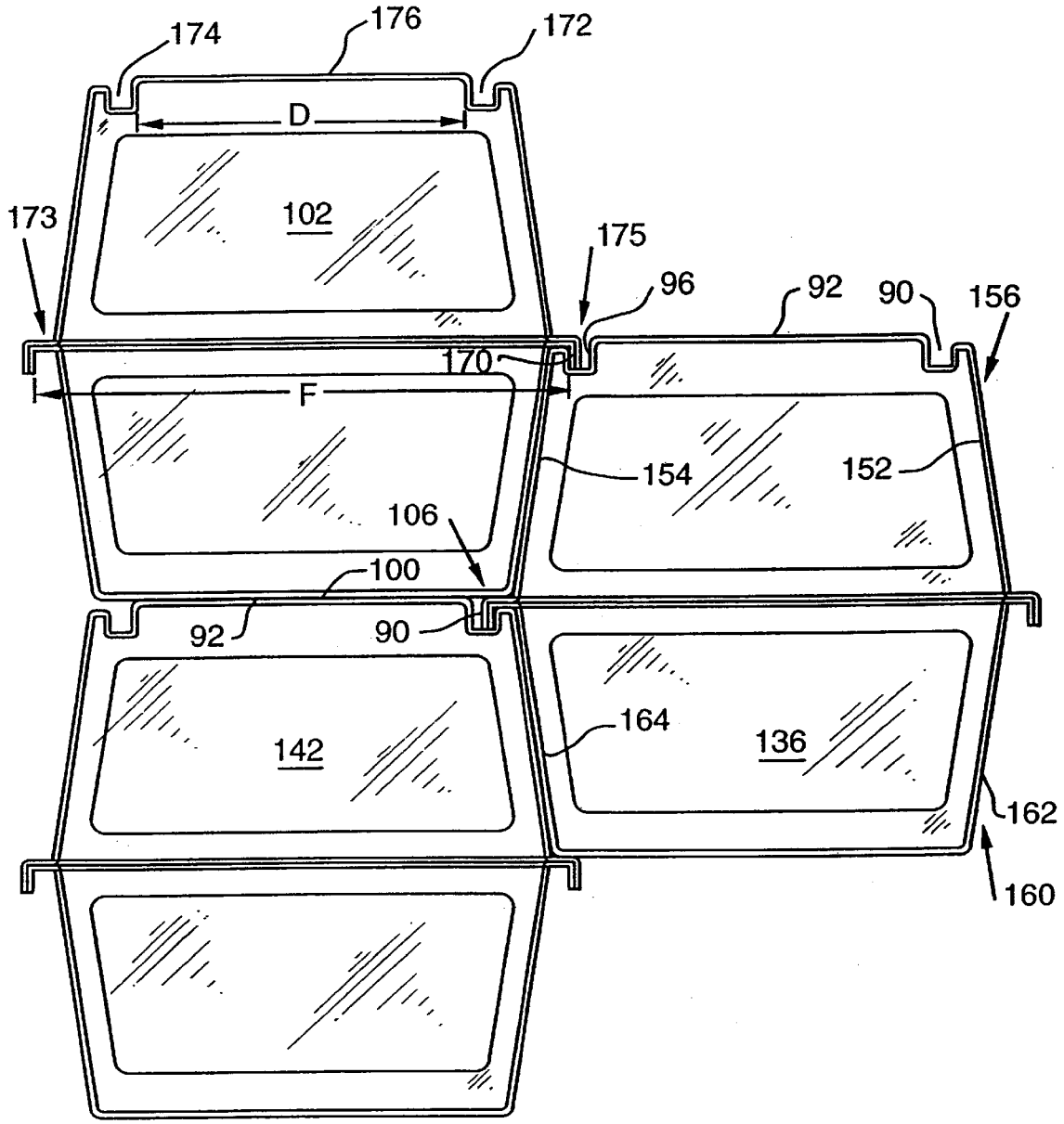
FIG. 6 is a front elevational view showing interengagement of three containers of the present invention.
Figure 7:
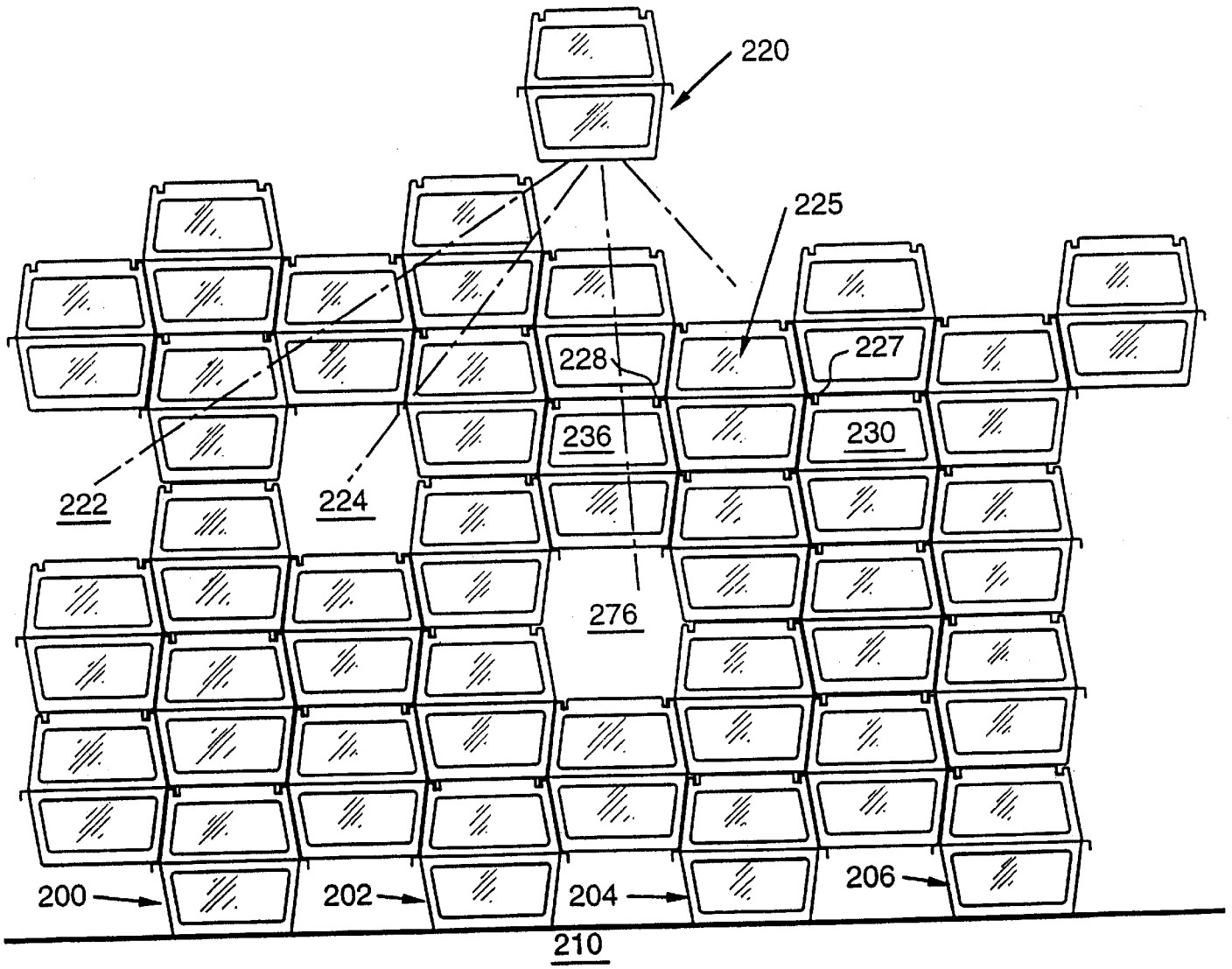
FIG. 7 is a front elevational view showing schematically an assembly of containers of the present invention.

Referring now to FIGS. 5–7, FIG. 5 shows an upwardly open channel 90 formed within an upper wall 92 of a container of the present invention. It will be noted that the upper wall 92 is generally planar and has a first section 94 disposed inwardly of channel 90 and an outer portion 98 which is at a lower level than the portion 94. A lower wall 100 of an overlying container 102 rests on portion 94. The flange consists of two components with one portion 106 being formed within the lower part of container upper portion 108 and having a generally horizontal portion 110 and a downwardly projecting portion 112. A second part of the flange is formed from an upper part of the lower portion 116 and has a horizontal portion 118 and a downwardly extending portion 120. The respective ends 122, 124 of the downwardly projecting flange portions 112, 120 terminate in spaced relationship above the upper surface 130 of the base of the upwardly open channel 90. It will also be seen that container 136 has its lower portion 116 disposed adjacent to the upper portion 140 of container 142. The adjacent columns of containers, therefore, have adjacent containers in relative staggered relationship. Also in the form shown in FIGS. 5 and 6, the upper portion 156 of container 136, has a pair of downwardly diverging generally planar side walls 152, 154 and the lower portion 160 has a pair of upwardly diverging generally planar side walls 162, 164. Side walls 116, 140 are shown as being in generally surface-to-surface adjacency in FIG. 5.

It will be appreciated that with the three containers 102, 136, 142 shown in FIG. 6, interengagement of the flange 106 of container 136 with upwardly open channel 90 effects interengagement between the two containers. Further, interengagement of flange 170 of container 102 with upwardly open channel 96, effects interengagement therebetween. The lower surface 100 of container 102 is also generally planar and rests in surface-to-surface engagement with upper surface 92 of container 142. It will be appreciated, therefore, that either engagement of a flange of a container within an upwardly open channel of another container or receipt within a container's channel of a flange of another container or both will result in interengagement of the containers to create a self-supported assembly of a plurality of containers.

The upwardly open channels such as 172, 174 of container 102, as shown in FIG. 6, preferably are co-extensive with the length of the upper surface 176 such that when a flange or flanges are inserted therein relative longitudinal sliding movement is provided to permit removal of a container from the self-supported assembly. The flanges may be co-extensive in length with the channels 172, 174 or shorter. If desired, one closed end may be integrally formed in the channels to provide an automatic stop for the flanges sliding therein. It will be appreciated that in the preferred form, the upwardly open channels, 172, 174 have at least one end open and preferably has both ends open and continuous channels to permit the desired sliding. The fact that the flange ends 122, 124 (FIG. 5) do not engage the bottom surface 130 in the preferred embodiment, facilitates ease of sliding.

Referring again to FIG. 5, it will be appreciated that the horizontal portions 110, 118 of flange components are supported on flat portion 98 of container 142.

With further reference to FIG. 6, it is noted that the distance D between the upwardly open channels 172, 174 is preferably less than the distance F between the flanges 173, 175. The distance D is preferably about 60 to 90 percent of distance F. It is preferred that the distance between the upwardly open channels 172, 174 be about 1.5 to 10 inches. It is preferred that the distance F between flanges 173, 175 be about 2 to 12 inches.

Referring to FIG. 7, an example of a self-supporting assembly of a large number of containers of the present invention providing a large number of effectively supported individually removable containers will be considered. Containers 200, 202, 204, 206 rest on the floor 210 and a container such as 220 may be introduced into any of openings 222, 224, 276 by longitudinal sliding movement as described hereinbefore. It will be noted that no shelves or other articles of furniture or other apparatus need be employed to effect support of the individual containers.

It will be appreciated that container 225, for example, has one flange 227 engaged with container 230 and another flange 228 engaged with container 236.

It will be understood that reference herein to the assembly being self-supporting shall not be interpreted as precluding a support, such as floor 210, underlying the entire assembly.

Figure 8:
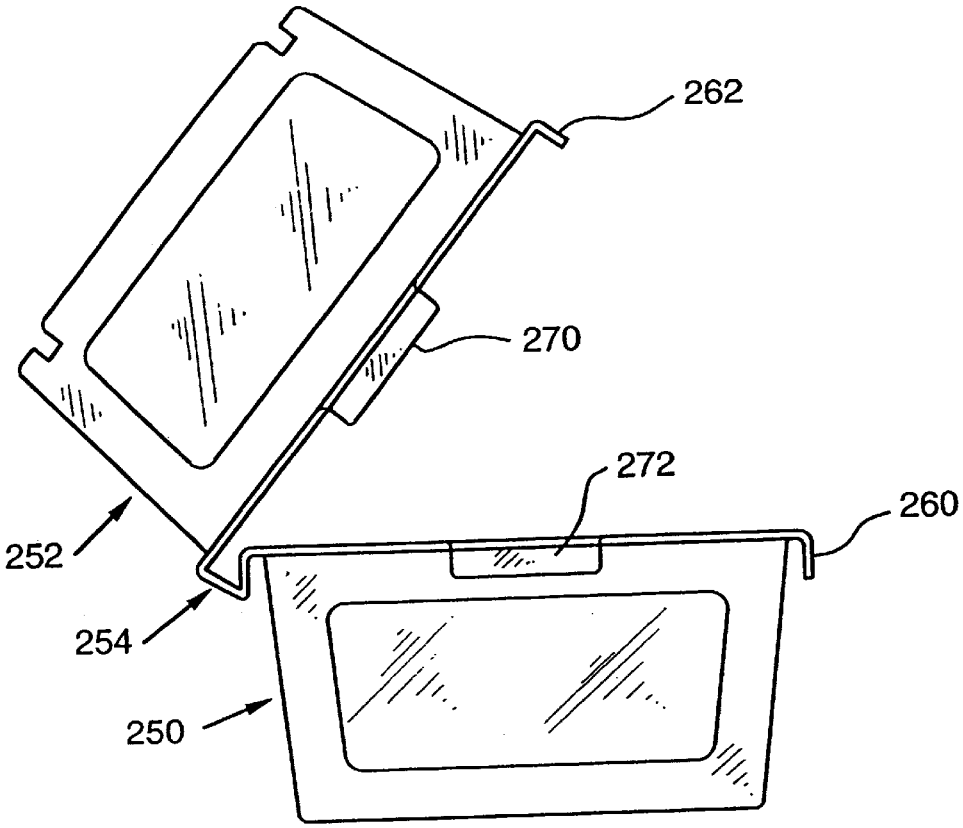
FIG. 8 is an illustration of a modified form of container of the present invention in an open position.

Referring to FIG. 8, a further embodiment of the invention will be considered. Whereas in the prior embodiments, the hinge connecting the upper portion with the lower portion is connected at the ends, this embodiment shows a lower portion 250 connected to an upper portion 252 by an integrally formed hinge 254 on the side of the container. The hinge 254 when the container is in a relative closed position also serves as a flange. The second flange consists of components 260, 262. Locking means 270, 272 are provided.

Figure 9:
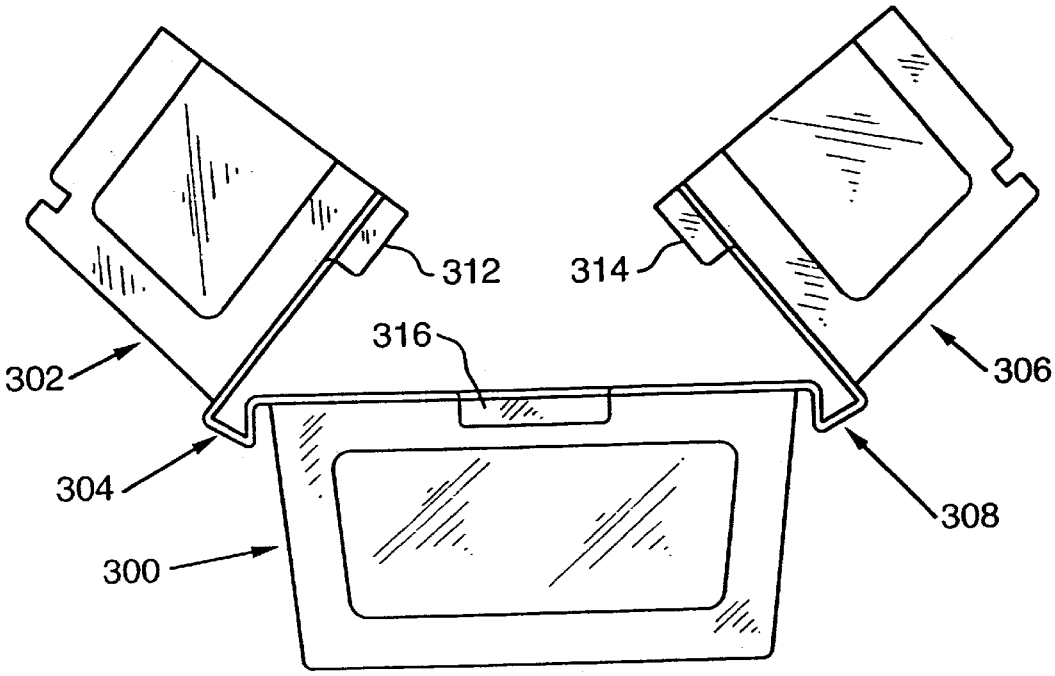
FIG. 9 is a front elevational view of another embodiment of the container of the present invention.

FIG. 9 shows a further embodiment of the invention wherein a base portion of the container 300 is secured to a first upper portion 302 by hinge means 304 and to a second upper portion 306 by a second hinge means 308. The hinge means 304, 308 serve as the flanges when the container is in closed position with locking elements 312, 314 being received in side-by-side adjacency within recess 316.

Figure 12:
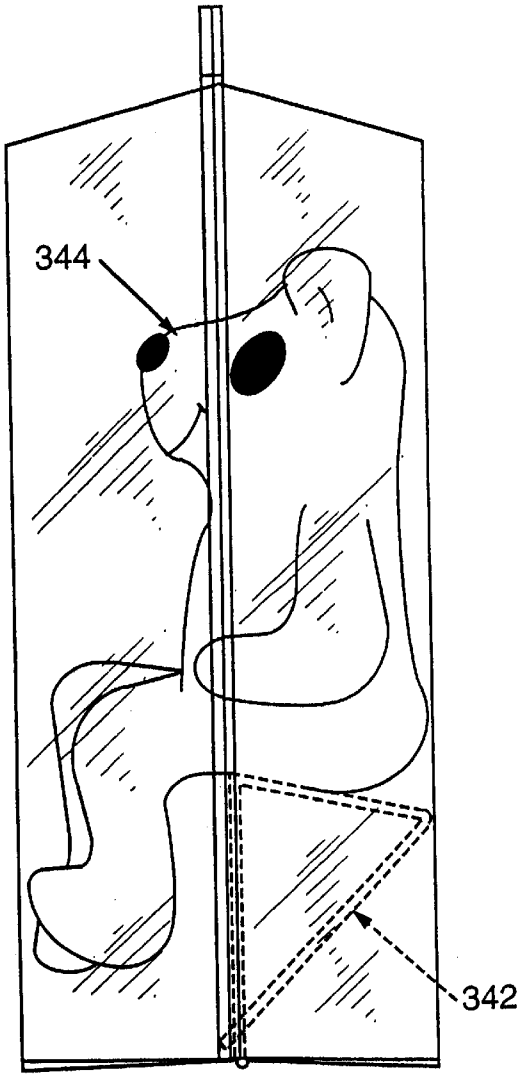
FIG. 12 is a side elevational view showing an animal figure supported within the container employing the support of FIG. 11.
Figure 11:
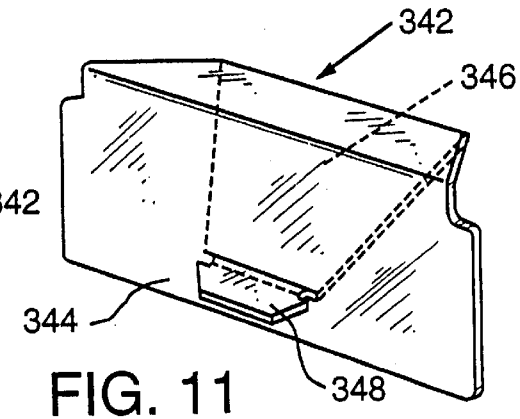
FIG. 11 is a perspective view of an interior support usable in the container of FIG. 10.
Figure 10:
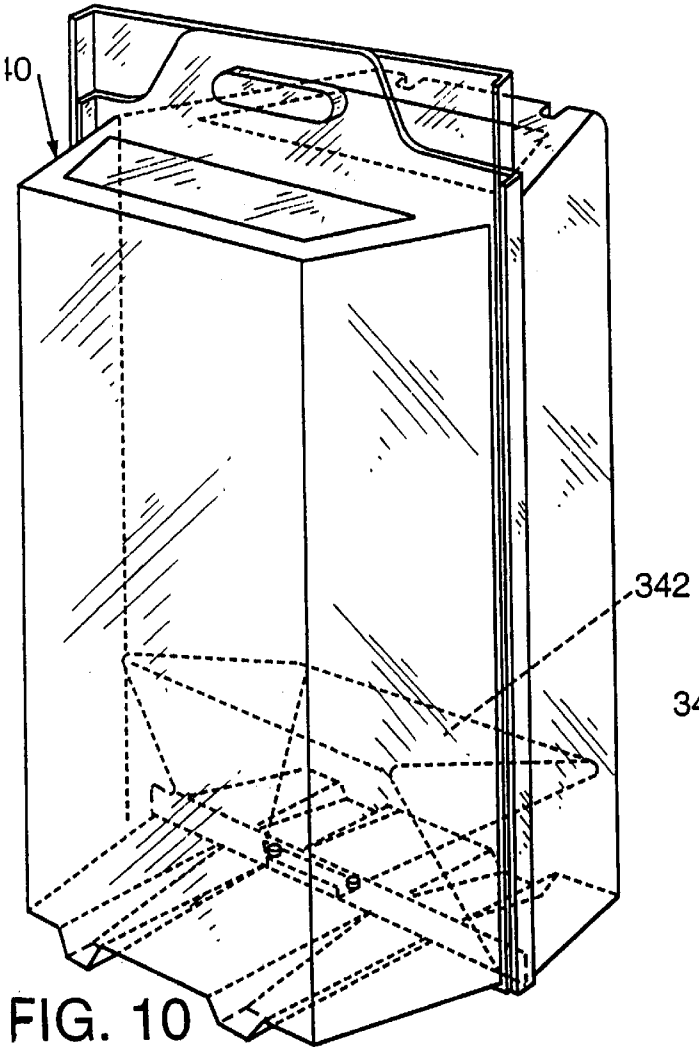
FIG. 10 is an illustration of the container of FIG. 1 showing interior support means.

Referring to FIGS. 10–12, it will be seen that container 340 has a support member 342 on which an article may be supported. Three-dimensional stuffed animal 344 is shown sitting on the support 342 which is shown in detail in FIG. 11 and may consist merely of a cardboard or plastic material folded into a hollow shape having a front wall 344, a rearwardly disposed tapered wall 346 and a tab 348 projecting through an opening in forward wall 344. The support 342 may be anchored within the container by any suitable means such as adhesive, glue or mechanical fasteners or a recess formed in the container for receipt of the support 342, for example.

Figure 13:
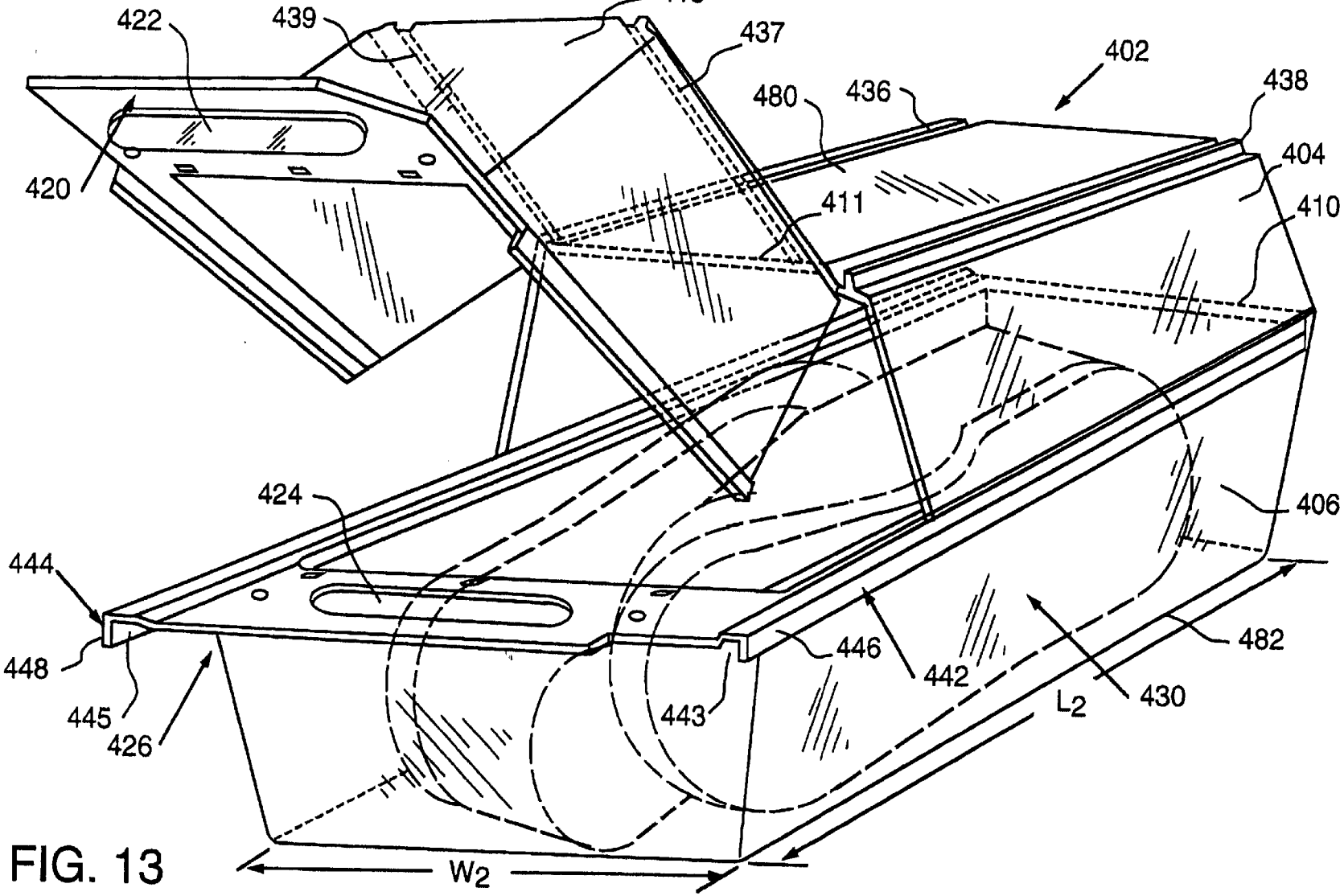
FIG. 13 is an isometric view of another embodiment of the container of the present invention in which is disposed a three-dimensional article.
Figure 14:
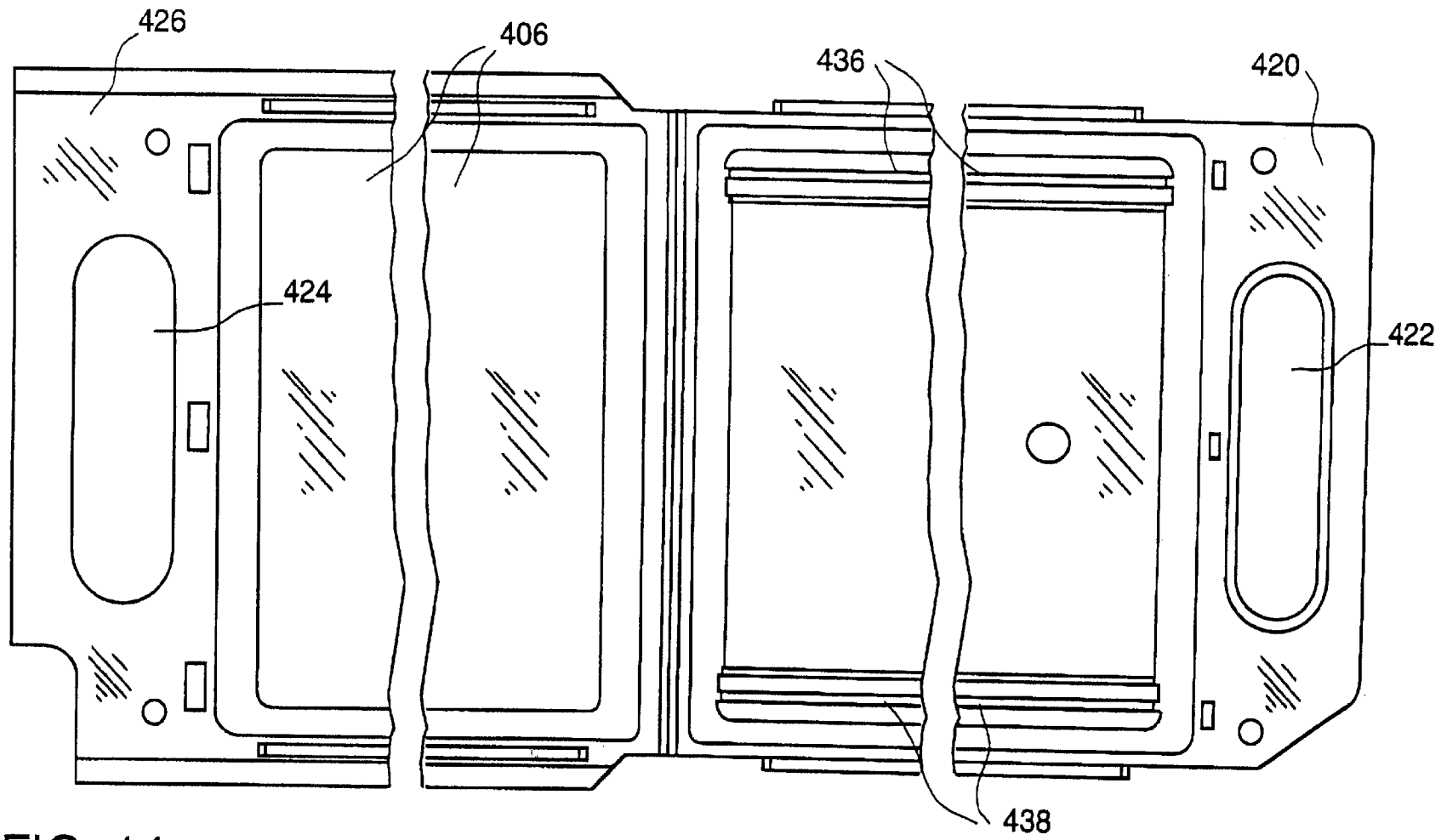
FIG. 14 is a sectioned top plan view of the container of the present invention.
Figure 15:
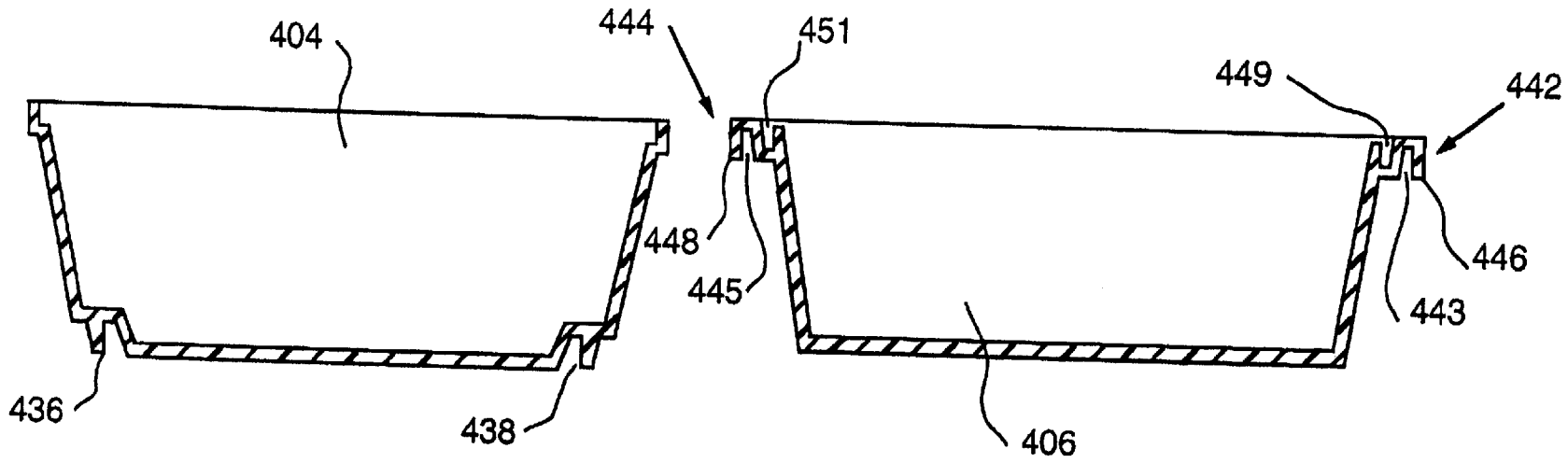
FIG. 15 is a front elevational view of a container of the present invention in two separate upper and lower portions.
Figure 16:
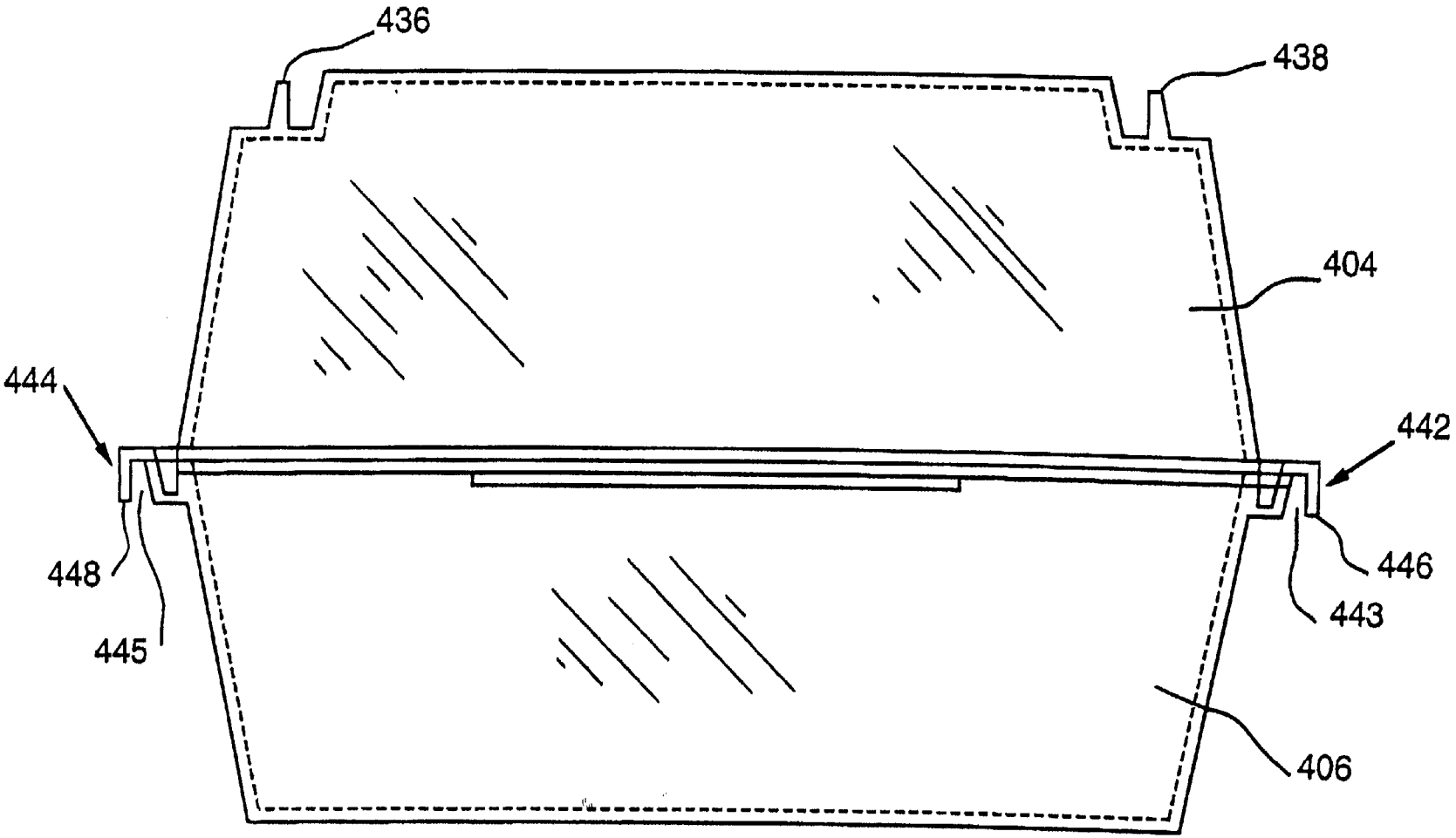
FIG. 16 is a front elevational view of a container of the present invention with the upper portion resting on the lower portion.

Referring now to FIGS. 13–16, in another embodiment of the present invention, there is shown a container 402 which has an upper portion 404 and a lower portion 406. First hinge means 410 and second hinge means 411 are integrally molded connecting portions in the form shown which create a "split" clamshell-type container. It can be appreciated that the upper and lower portions 404, 406 can alternatively be provided as separate, individual pieces which are not connected by a first hinge means 410 as shown more particularly in FIG. 15. In FIG. 13, there is also shown a projecting extension 420 which contains a plug 422 which, when the container 402 is in closed position, will be received in opening 424 on extension 426 so as to lock the assembly in the closed position. In the form shown in FIG. 13, an article of clothing, generally in the form of a pair of shoes 430, is shown seated within the container 402.

It will be appreciated that, with the container made of a transparent material, the full article can be viewed from various angles without requiring opening the same to risk damage thereto and permit dirt to enter the container 402 and come in contact with the article. If desired, the material out of which the container is made may be tinted or contain an additive to resist passage of ultraviolet radiation therethrough. Many suitable ultraviolet inhibitors are known to those skilled in the art and thereby resist ultraviolet damage to the article. Further, the container of the present invention is preferably manufactured by an injection molding process that allows for relatively sharper edges and provides relatively tighter radii in container structure.

For many uses, the container, as shown in FIGS. 13–16, will have the base 406 resting on a support surface such as a floor or table with the upper portion 404 overlying the same. For convenience of reference and consistency of disclosure herein, when the container is in a closed position, rails 436, 438 which are integrally formed within the lower portion 406 will be described as being upwardly projecting. Shown also are downwardly projecting flange means 442, 444. The flanges 442, 444 each include a downwardly projecting portion 446, 448, respectively. The flanges 442, 444 form downwardly projecting channels 443, 445 therein which are adapted to receive an upwardly projecting rail such as the rail 438 of an adjacent container in establishing the assembly in the manner to be described herein. The lower portion 406 also has channel receiving means 449,451 typically co-extensive with the length of the container and generally upwardly open and adapted to receive the upper portion 404 thereon.

It will be appreciated that the configurations of the containers are such that they, when empty and open, may be nested for shipment to the destination where they will be used.

Referring again to FIG. 13, while the dimensions of the container will vary according to the particular end use desired, the container may, for example, have a length $L_2$ of about 4 to 12 inches, a width $W_2$ of about 2 to 12 inches and an overall height when closed measured between the upper surface 480 of the upper portion 404 and the lower surface 482 of lower portion 406 of about 2 to 6 inches. In a preferred embodiment, the wall thickness of the container is about 0.010 to 0.060 inch and most preferably about 0.020 to 0.025 inch. It will be appreciated that while the material and thickness of the material may provide a certain degree of flexibility to the container, that it is such as to retain its molded shape. Among the materials preferred for manufacture of the containers are polycarbonate polyvinyl chloride and acrylonitrile butadiene styrene (ABS).

Figure 17:
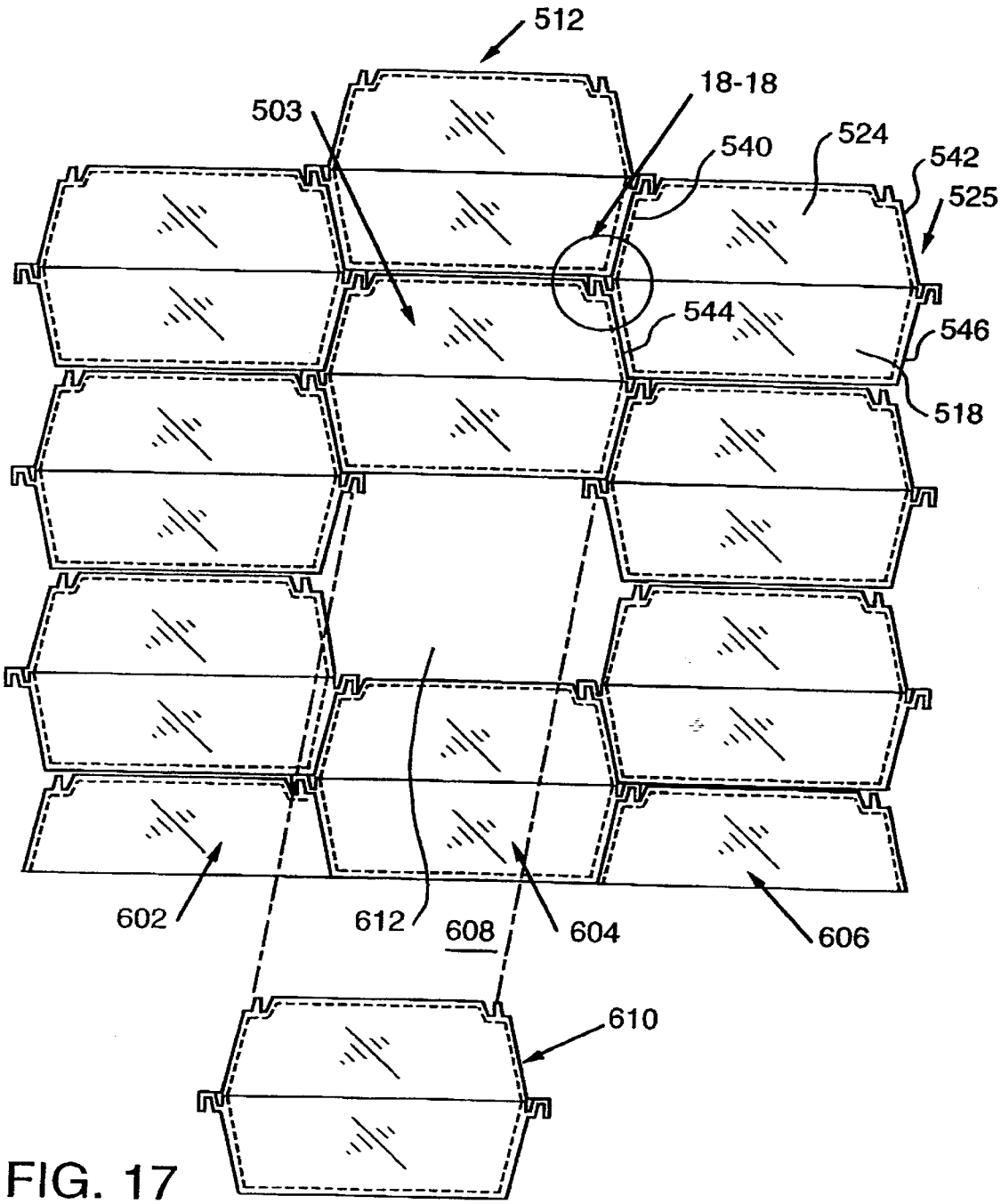
FIG. 17 is a front elevational, partially schematic view of an assembly of containers of the present invention.
Figure 18:
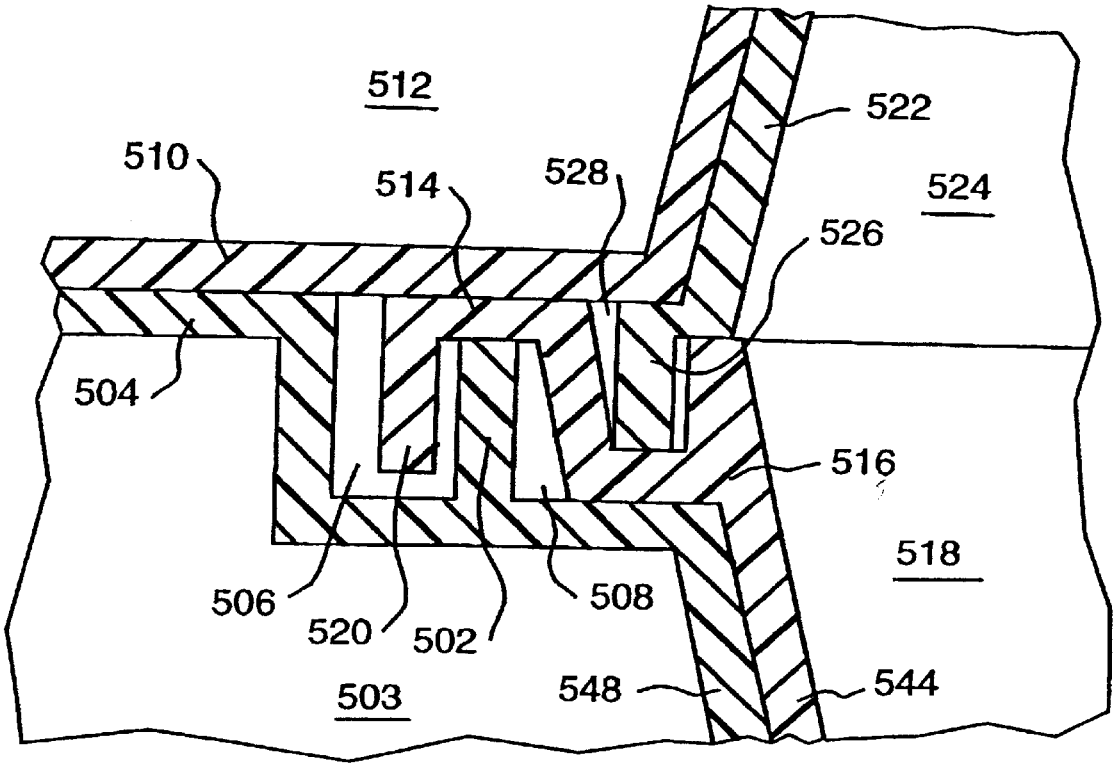
FIG. 18 is an enlarged sectional view of a portion of FIG. 17 showing the interengagement between containers.

Referring now to FIGS. 17 and 18, an upwardly projecting rail 502 is formed within an upper wall 504 of a container 503 of the present invention. It will be noted that a first rail channel section 506 is disposed inwardly of rail 502 and a second rail channel section 508 is disposed outwardly of the rail 502. A lower wall 510 of an overlying container 512 rests on upper wall 504. The flange 514 is formed integrally with the side wall 516 of an adjacent container lower portion 518 and has a downwardly projecting portion 520 which extends into the first rail channel section 506 in a spaced relationship with the rail 502 and the upper wall 504 of container 503. The end of the rail 502 preferably maintains substantially intimate contact with the lower wall 510 of container 512. In addition, a side wall 522 of container upper portion 524 has a downwardly projecting portion 526 which is received into a receiving channel 528 formed within the flange 514.

Referring again to FIG. 17, the adjacent columns of containers, therefore, have adjacent containers in relative staggered relationship. Also in the form shown in FIGS. 17 and 18, the upper portion 524 of container 525, has a pair of downwardly diverging generally planar side walls 540, 542 and the lower portion 518 has a pair of upwardly diverging generally planar side walls 544,546. For example, side walls 544, 548 are shown as being in generally surface-to-surface adjacency in FIG. 18.

Referring again to FIGS. 17 and 18, it will be appreciated that with the three containers 503,512,525 shown in FIG. 17, interengagement of the rail 502 of container 503 with flange 514 of lower portion 518 of the container 525 effects interengagement between the two containers. Furthermore, the position of lower wall 510 of container 512 with respect to the upper wall 504, the flange 514 and the wall 522, effects interengagement among the containers 503,512,525. It will be appreciated, therefore, that either engagement of a rail of a container within a downwardly open channel of another container or receipt within a container's channel of a rail of another container or both will result in interengagement of the containers to create a self-supported assembly of a plurality of containers.

The upwardly projecting rails such as 436,438 of container 402, as shown in FIG. 13, preferably are co-extensive with the length of the upper surface 480 such that when a downwardly open channel or channels ride thereon, relative longitudinal sliding movement is provided to permit removal of a container from the self-supported assembly. In addition, it can be appreciated that a lid portion 413 shown in FIG. 13 which is hingably attached to the upper portion 404 of the container 402 permits the removal of an article, such as shoes 430, from a self-supported assembly of a plurality of containers, such as shown in FIG. 17, without complete removal of the container 402 from the assembly. The lid portion 413 is preferably provided with rail segments 437,439 which are formed integrally with the lid portion 413 and which align with rails 438,436, respectively when the lid portion is in its closed position (not shown). The flange means 442,444 may also be co-extensive in length with the rails 436,438 or shorter. If desired, one closed end may be integrally formed in the channels 443,445 to provide an automatic stop for the rails sliding therein. It will be appreciated that in the preferred form, the channels 443,445 have at least one end open and preferably have both ends open and continuous channels to permit the desired sliding.

Referring again to FIG. 17, an example of a self-supporting assembly of a large number of containers of the present invention providing a large number of effectively supported individually removable containers will be considered. Containers 602,604,606 rest on the floor 608 and a container such as 610 may be introduced into an opening such as opening 612 by longitudinal sliding movement as described hereinbefore. It will be noted that no shelves or other articles of furniture or other apparatus need be employed to effect support of the individual containers. It will also be understood that reference herein to the assembly being self-supporting shall not be interpreted as precluding a support, such as floor 608, underlying the entire assembly.

The containers 602,606 can be provided as relatively smaller container of approximately one half the size of container 604, for example. It will be understood that these half containers 602,606 are preferably employed at the base of an assembly of a plurality of containers to fill the void formed by the natural stagger of the assembly structure. Such half containers 602,606 have the appropriate rail, flange and/or channel structures to permit their relative longitudinal sliding motion into and out of the assembly and can be used for articles designed to fit in the space provided by these containers 602,606. The half containers 602,606 can be provided with a conventional lid such as a flat lid with a wrap-around edge known in the art for covering and protecting the contents of a half container.

Figure 19:
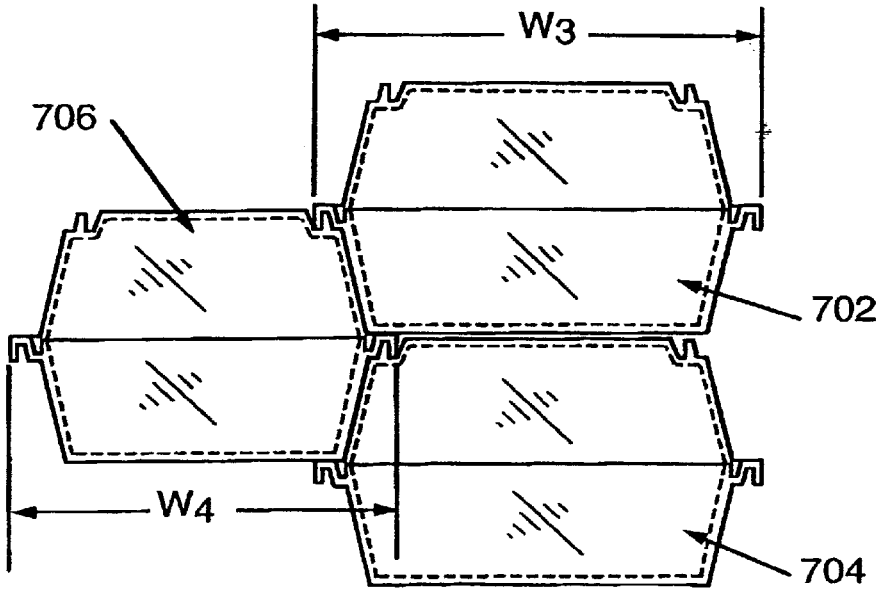
FIG. 19 is a front elevational view of a portion of another embodiment of the assembly of the present invention.

Referring now to FIG. 19, another aspect of the present invention is shown by viewing a portion of an assembly of a plurality of containers. The containers 702,704 are substantially the same size and the container 706 is relatively smaller than the containers 702,704 such as by having a width $W_4$ that is fraction of the width $W_3$ of the containers 702,704. Alternatively, it can be appreciated that different regular or irregular patterns can be formed utilizing a variety of dimensionally different containers. For example, columns of containers of a first width positioned adjacent to containers of a second smaller or larger width can be provided based on the desires of the user and factors such as advertising appeal. It is understood that proper interengagement of the channel, flange and/or rail structures employed in such patterns are maintained to permit ease of relative longitudinal sliding movement for a structured assembly of containers. In any event, it is understood that the scope of the present invention is intended to include the gamut of different patterns and other arrangements into which the assembly of containers can be structured.

Figure 20:
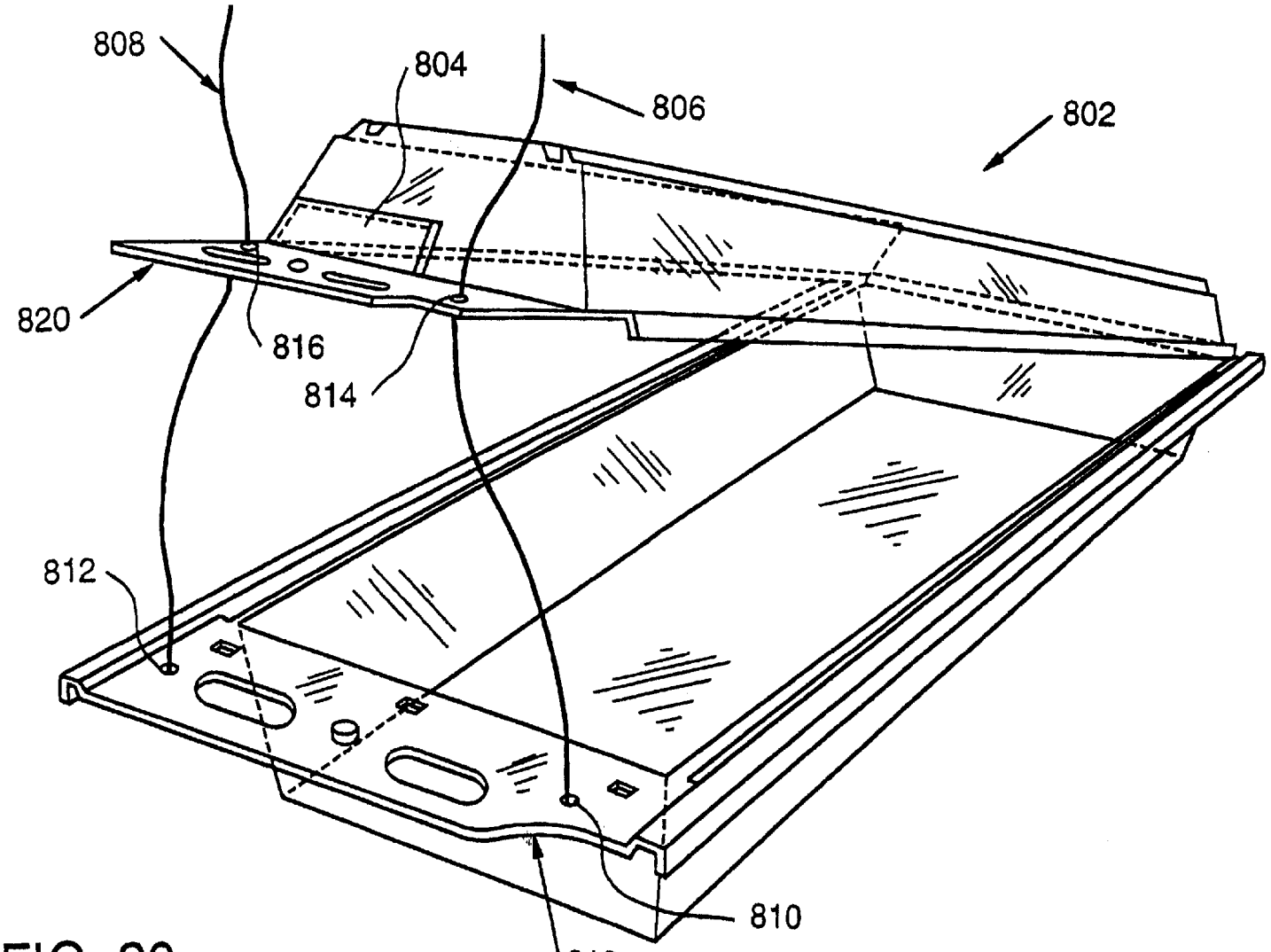
FIG. 20 is a perspective view of another embodiment of the container of the present invention.

Referring now to FIG. 20, in another aspect of the present invention, a container 802 can be provided with an identification tag 804 formed thereon for indicating the contents of the container 802 to a consumer or other person accessing the container 802. The identification tag 804 is preferably made of a material which is suitable both for printing indicia thereon and for permitting adherence of the tag to a desired portion of the container 802. In the form shown in FIG. 20, sections of string 806,808 or other suitable binding means can be interlaced between holes 810,812,814,816 formed in the extension portions 818,820 of the container 802. It can be appreciated that the binding means employed can be made of a fabric with characteristics such as color and texture which are desirable in the marketing of the contents of the container 802.

It will also be appreciated that the container of the present invention may have a live hinge which tends to urge the container into an open position when it is not secured in a closed position.

It will be appreciated that the present invention provides a uniquely structured self-supporting assembly of containers which facilitates removal of individual containers and return thereof to the assembly without destruction of the assembly. It can also be understood that a variety of articles can be stored within and accessed from the container. Examples of such articles include, but are not limited to, plant starters such as for shipments from greenhouse related facilities; plant growing such as mushroom growing beds that are recyclable and reusable by a gardener; storage of craft related items such as needles and thread; storage of compact discs (CD's); storage of utility items such as hardware in a tool shop area; and, storage and delivery for flowers and plants.

Whereas particular embodiments of the invention have been described above for purposes of illustration, it will be evident to those skilled in the art that numerous variations of the details may be made without departing from the invention as defined in the appended claims.

What is claimed is:

1. An assembly of interconnected containers comprising a plurality of containers, said containers having an upper portion engaged with a lower portion with the upper portion having a pair of elongated generally parallel upwardly projecting rails, said containers having a pair of generally parallel generally downwardly projecting flanges forming a pair of generally parallel generally downwardly open channels structured to receive a said upwardly projecting rail of an adjacent said container, at least some of said containers having (a) at least one said rail engaged with a said flange of an adjacent said container, and (b) at least one said flange engaged with a rail of another adjacent said container, whereby a said container may be removed from said assembly by effecting relative sliding movement of said engaged flanges and rails;

a said rail of a first container disposed in a said channel of a second said container; and said first container having a said upper portion disposed adjacent to the lower portion of said second container.

2. The assembly of interconnected containers of claim 1 including said channels having at least one open end to permit relative sliding movement between said channel and a said rail engaged therein, whereby specified individual containers may be removed from said assembly by relative sliding movement, without removal of other containers from said assembly.

3. The assembly of interconnected containers of claim 1 including at least one of said containers having a lid portion hingably attached to said upper portion of said container to permit removal of contents from said container without removing said container from said assembly.

4. The assembly of interconnected containers of claim 1 including said containers having an upper wall and a pair of upper side walls diverging downwardly therefrom and a lower wall with a pair of lower side walls diverging upwardly therefrom.

5. The assembly of interconnected containers of claim 1 including said upwardly projecting rails being in contact with said downwardly open channels of said flanges.

6. The assembly of interconnected containers of claim 1 including a lower side wall of said first container being in surface-to-surface engagement with an upper side wall of a third container.

7. The assembly of interconnected containers of claim 1 including said containers being composed of a transparent resinous material.

8. The assembly of interconnected containers of claim 1 including said containers having an average wall thickness of about 0.010 to 0.060 inch.

9. The assembly of interconnected containers of claim 1 including said containers having integrally formed locking means.

10. The assembly of interconnected containers of claim 1 including both said upwardly projecting rails being substantially co-extensive with the upper portion of said containers.

11. The assembly of interconnected containers of claim 1 including said assembly being self-supporting on a surface.

12. The assembly of interconnected containers of claim 1 including said containers being made from a material containing an ultraviolet inhibitor.

13. The assembly of interconnected containers of claim 1 including at least one of said containers having its said upper portion hingably connected to its said lower portion.

14. The assembly of interconnected containers of claim 1 including identification means attached to a portion of at least one of said containers.

15. The assembly of interconnected containers of claim 1 including at least one half container positioned adjacent to at least one half of an adjacent half container.

16. The assembly of interconnected containers of claim 15 including said half container being positioned adjacent to a support surface for said assembly.

17. An assembly of interconnected containers comprising a plurality of containers, said containers having an upper portion engaged with a lower portion with the upper portion having a pair of elongated generally parallel upwardly projecting rails, said containers having a pair of generally parallel generally downwardly projecting flanges forming a pair of generally parallel generally downwardly open channels structured to receive a said upwardly projecting rail of an adjacent said container, at least some of said containers having (a) at least one said rail engaged with a said flange of an adjacent said container and (b) at least one said flange engaged with a rail of another adjacent said container, whereby a said container may be removed from said assembly by effecting relative sliding movement of said engaged flanges and rails;

said assembly having a plurality of columns of said containers, and containers in one said column being in relative staggered relationship with respect to containers in an adjacent column.

18. A container comprising an upper portion resting on a lower portion with the upper portion having a pair of elongated generally parallel upwardly projecting rails, a pair of generally parallel generally downwardly projecting flanges having downwardly projecting channels formed therein to engage a said upwardly projecting rail of an adjacent said container, said channels having at least one open end, each of said pair of flanges having a first downwardly projecting portion formed in a lower part of said upper portion, and a second portion formed in an upper part of said lower portion, and said container being structured to engage other containers by having said flanges engage said upwardly projecting rails of another said container, to establish an assembly of a plurality of said containers, whereby a said container may be removed from said assembly by effecting relative sliding movement of said engaged flanges and said channels without required removal of other containers from said assembly.

19. The container of claim 18 including said channels having at least one open end to permit relative sliding movement between said channel and a said rail engaged therein, whereby containers may be removed from an assembly of said containers by relative sliding movement without requiring removal of other containers from said assembly.

20. The container of claim 18 including at least one of said containers having a lid portion hingably attached to said upper portion of said container to permit removal of contents from said container without removing said container from said assembly.

21. The container of claim 20, wherein said contents are shoes.

22. The container of claim 19, including said container being composed of a transparent resinous material.

23. The container of claim 18 including said container having an average wall thickness of about 0.010 to 0.060 inch.

24. The container of claim 18 including said container having integrally formed locking means.

25. The container of claim 18 including both said upwardly projecting rails being substantially co-extensive with the upper portion of said container.

26. The container of claim 18 including said containers being made from a material containing an ultraviolet inhibitor.

27. The container of claim 18 including identification means attached to a portion of said container.

* * * * *